US005582963A

United States Patent [19]

Tsukada

[11] Patent Number: 5,582,963

[45] Date of Patent: Dec. 10, 1996

[54] PROCESS FOR PREPARATION OF SILVER HALIDE PHOTOGRAPHIC MATERIAL HAVING EMULSION LAYER AND ANTISTATIC BACKING LAYER

[75] Inventor: Yoshihisa Tsukada, Kanagawa, Japan

[73] Assignee: Fuji Photo Film Co., Ltd., Minami-Ashigara, Japan

[21] Appl. No.: 550,202

[22] Filed: Oct. 30, 1995

[30] Foreign Application Priority Data

Oct. 28, 1994 [JP] Japan ..... 6-265179

[51] Int. Cl.[6] ..... G03C 1/85

[52] U.S. Cl. ..... 430/527; 430/523; 430/524; 430/530; 430/536; 430/537; 430/935; 430/631; 430/637

[58] Field of Search ..... 430/523, 527, 430/524, 530, 536, 537, 935, 631, 637

[56] References Cited

U.S. PATENT DOCUMENTS

| | | | |
|---|---|---|---|
| 2,400,532 | 5/1946 | Blake et al. | 430/637 |
| 3,507,660 | 4/1970 | Nishio et al. | 430/637 |
| 3,516,833 | 6/1970 | Hagge et al. | 430/637 |
| 4,510,233 | 4/1985 | Yokoyama et al. | 430/527 |
| 4,518,354 | 5/1985 | Yokoyama et al. | 430/527 |
| 5,013,640 | 5/1991 | Bagchi et al. | 430/637 |
| 5,135,844 | 8/1992 | Bagchi et al. | 430/637 |
| 5,326,689 | 7/1994 | Murayama | 430/530 |

FOREIGN PATENT DOCUMENTS 5494961A 6/1993 European Pat. Off. .

*Primary Examiner*—Geraldine Letscher
*Attorney, Agent, or Firm*—Burns, Doane, Swecker & Mathis, LLP

[57] ABSTRACT

A silver halide photographic material comprises a plastic support, a silver halide emulsion layer and an antistatic backing layer. A process for the preparation of the photographic material comprises the steps of: coating a silver halide emulsion on one side of the support to form the silver halide emulsion layer; and coating an aqueous coating solution on the other side of the support to form the antistatic backing layer. The coating solution contains electroconductive particles, a binder and a specific nonionic surface active agent represented by the formula (Ia), (Ib), (II), (III) or (IV).

20 Claims, No Drawings

PROCESS FOR PREPARATION OF SILVER HALIDE PHOTOGRAPHIC MATERIAL HAVING EMULSION LAYER AND ANTISTATIC BACKING LAYER

FIELD OF THE INVENTION

The present invention relates to a silver halide photographic material comprising a plastic support, a silver halide emulsion layer and an antistatic backing layer.

BACKGROUND OF THE INVENTION

A silver halide photographic material usually comprises a silver halide emulsion layer provided on a plastic support. The plastic support is made of a cellulose derivative (e.g., triacetylcellulose) or a polyester (e.g., polyethylene terephthalate, polyethylene naphthalate).

Plastic tends to be charged due to rubbing because plastic is a non-conductive material. If a photographic material is charged, an electric discharge makes a static mark on an image. Further, the charged material gathers dust. Therefore, an electroconductive layer, namely an antistatic layer is provided on a photographic material having a plastic support to prevent the static charge. The anitistatic layer is usually provided on the backing surface of the plastic support.

The antistatic backing layer of the photographic material is described in Japanese Patent Provisional Publication Nos. 49(1974)-121523, 51(1976)-30725, 55(1980)-70837, 55(1980)-95942 and 57(1982)-118242.

The antistatic backing layer contains electroconductive particles and a binder. In the process for the preparation of the photographic material, an aqueous coating solution containing the particles and the binder is coated on the plastic support to form the antistatic layer. However, the plastic support repels the aqueous solution because the affinity between the plastic and the solution is low. Accordingly, the antistatic layer does not sufficiently adhere to the plastic support. Further, it is difficult to form the anitistatic layer uniformly and smoothly on the support. The antistatic layer tends to be peeled from the plastic support where the adhesion between the layer and the support is insufficient. Further, a printed image is distorted where the antistatic layer is not uniformly formed. Furthermore, a static mark is made in the image where the layer is not smoothly formed.

Various means have been proposed to solve the above-mentioned problems.

The surface of the plastic support can be subjected to a hydrophilic treatment to increase the affinity between the support and the aqueous coating solution. The hydrophilic treatments include a glow discharge treatment, an ultraviolet irradiation treatment and a corona discharge treatment. For example, U.S. Pat. No. 5,326,689 (Murayama) discloses a silver halide photographic material having a polyester support, which is subjected to a glow discharge treatment. However, the affinity between the treated support and the coating solution is still insufficient.

A surface active agent (a coating aid) can be added to the aqueous coating solution to increase the affinity. In Example 1 of U.S. Pat. No. 5,326,689 (at column 22), polyoxyethylene nonylphenylether is added to the coating solution of the antistatic backing layer. The polyoxyethylene (i.e., polyethylene glycol) surface active agent is commonly used in a silver halide photographic material. However, the affinity between the support and the coating solution containing the polyoxyethylene surface active agent is still insufficient.

Further, the common polyoxyethylene surface active agent causes another problem on a silver halide emulsion layer. A process for the preparation of the photographic material often comprises the steps in order of forming the antistatic backing layer on one side of the support, winding the support on a roll, and then forming the emulsion layer on the other side of the support. The common polyoxyethylene surface active agent in the antistatic layer is transferred to the other side of the support when the support is wound on the roll. The transferred surface active agent decreases the adhesion between the support and the layer provided on the side, such as a silver halide emulsion layer. Further, the common polyoxyethylene surface active agent decreases the adhesion between the antistatic backing layer and another backing layer provided on the antistatic layer.

The problems can be solved by using a hydrophobic organic solvent in place of water in the coating solution. However, the organic solvent has problems about danger of explosion. Further, the evaporated solvent should be evacuated. Therefore, an aqueous coating solution is preferred to the hydrophobic solution. The problems should be solved by improving the aqueous coating solution.

SUMMARY OF THE INVENTION

An object of the present invention is to provide a process for the preparation of a silver halide photographic material improved in the adhesion between a plastic support and an antistatic backing layer.

Another object of the invention is to provide a process for the preparation of a photographic material having a smooth and uniform antistatic backing layer.

A further object of the invention is to provide a process for the preparation of a photographic material, wherein a surface active agent contained in an antistatic backing layer has little influence on a silver halide emulsion layer.

The first embodiment of the present invention is a process for the preparation of a silver halide photographic material comprising a plastic support, a silver halide emulsion layer and an antistatic backing layer, which comprises steps of: coating a silver halide emulsion on one side of the support to form the silver halide emulsion layer; and coating an aqueous coating solution on the other side of the support to form the antistatic backing layer, wherein the coating solution contains electroconductive particles, a binder and a compound represented by the formula (Ia) or (Ib):

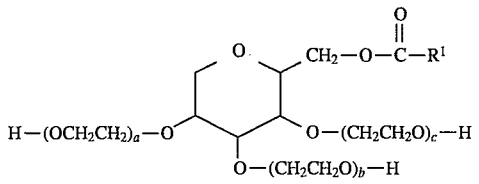

(Ia)

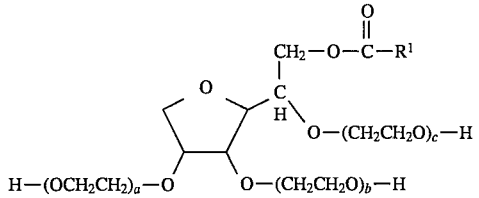

(Ib)

wherein $R^1$ is an alkyl group having 4 to 24 carbon atoms or an alkenyl group having 4 to 24 carbon atoms; each of a, b and c is an integer of 0 to 90, and the sum of a, b and c is an integer of 10 to 90.

The second embodiment of the invention is a process for the preparation of a silver halide photographic material comprising a plastic support, a silver halide emulsion layer and an antistatic backing layer, which comprises steps of: coating a silver halide emulsion on one side of the support to form the silver halide emulsion layer; and coating an aqueous coating solution on the other side of the support to form the antistatic backing layer, wherein the coating solution contains electroconductive particles, a binder and a compound represented by the formula (II):

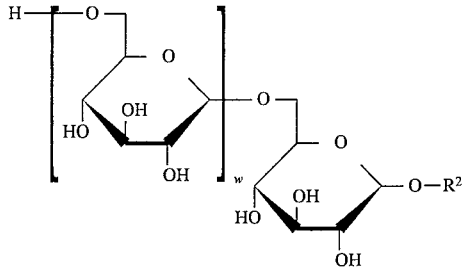

(II)

wherein $R^2$ is an alkyl group having 4 to 24 carbon atoms; and w is 0 to 3.

The third embodiment of the invention is a process for the preparation of a silver halide photographic material comprising a plastic support, a silver halide emulsion layer and an antistatic backing layer, which comprises steps of: coating a silver halide emulsion on one side of the support to form the silver halide emulsion layer; and coating an aqueous coating solution on the other side of the support to form the antistatic backing layer, wherein the coating solution contains electroconductive particles, a binder and a compound represented by the formula (III):

$$HO-(CH_2CH_2O)_x-(CH_2\overset{\overset{CH_3}{|}}{C}HO)_y-(CH_2CH_2O)_z-H \quad \text{(III)}$$

wherein each of x and z is an integer of 0 to 300, and the sum of x and z is an integer of 20 to 300; y is an integer of 15 to 70.

The fourth embodiment of the invention is a process for the preparation of a silver halide photographic material comprising a plastic support, a silver halide emulsion layer and an antistatic backing layer, which comprises steps of: coating a silver halide emulsion on one side of the support to form the silver halide emulsion layer; and coating an aqueous coating solution on the other side of the support to form the antistatic backing layer, wherein the coating solution contains electroconductive particles, a binder and a compound represented by the formula (IV):

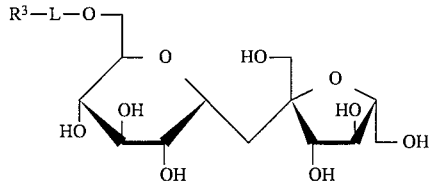

(IV)

wherein $R^3$ is an alkyl group having 4 to 24 carbon atoms or an alkenyl group having 4 to 24 carbon atoms; L is a single bond, —CO—, —NH—CO— or —OP(O)($OR^4$)—, and $R^4$ is hydrogen, an alkyl group having 1 to 24 carbon atoms or an alkenyl group having 2 to 24 carbon atoms.

The present invention is characterized in that a compound represented by the formula (Ia), (Ib), (II), (III) or (IV) functions as a nonionic surface active agent (coating aid) in a coating solution of an antistatic backing layer.

The applicant has found that the compounds of the formulas (Ia), (Ib), (II), (III) and (IV) greatly increase the affinity between a plastic support and an aqueous coating solution of an antistatic backing layer. Therefore, a silver halide photographic material improved in the adhesion between the plastic support and the antistatic backing layer can be prepared according to the present invention. Further, a photographic material having a smooth and uniform antistatic backing layer can also be prepared according to the invention.

The compounds of the formulas (Ia), (Ib), (II), (III) and (IV) coated on one side of the support are scarcely transferred to the other side of the support when the support is wound on a roll. Accordingly, the compounds have little influence on a silver halide emulsion layer provided on the other side of the support. Further the compounds of the formulas (Ia), (Ib), (II), (III) and (IV) have little influences on the adhesion between the antistatic backing layer and another backing layer provided on the antistatic layer.

The compound represented by the formula (Ia), (Ib), (II), (III) or (IV) has been known as a nonionic surface active agent contained in a coating solution of a silver halide emulsion layer or other layers provided on the emulsion side of the support. The compound of the formula (Ia) or (Ib) is disclosed in U.S. Pat. No. 2,400,532. The compound of the formula (II) is disclosed in European Patent Publication No. 549496A1. The compound of the formula (III) is disclosed in U.S. Pat. Nos. 5,013,640 and 5,135,844. The compound of the formula (IV) is disclosed in U.S. Pat. Nos. 3,507,660 and 3,516,833. However, these documents are silent with respect to the above-mentioned unexpected effects of the present invention.

DETAILED DESCRIPTION OF THE INVENTION

[Nonionic Surface Active Agent]

The first embodiment of the present invention uses a compound represented by the formula (Ia) or (Ib):

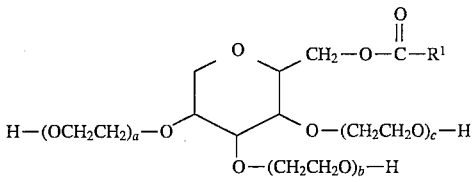

(Ia)

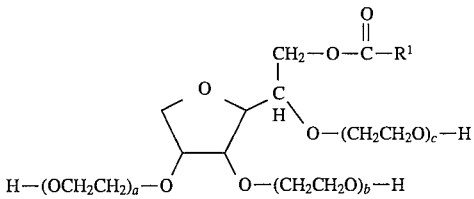

(Ib)

In the formula (Ia) or (Ib), $R^1$ is an alkyl group having 4 to 24 carbon atoms or an alkenyl group having 4 to 24 carbon atoms, preferably is an alkyl group having 6 to 20 carbon atoms or an alkenyl group having 6 to 20 carbon atoms, and more preferably is an alkyl group having 8 to 18 carbon atoms or an alkenyl group having 8 to 18 carbon atoms.

The alkyl group and the alkenyl group preferably have chain structures, though they may have cyclic structures. The alkyl and alkenyl groups of the chain structures may have branched chains. The alkyl group is preferred to the alkenyl group. There is no specific limitation with respect to the position of the double bond in the alkenyl group.

In the formula (Ia) or (Ib), each of a, b and c is an integer of 0 to 90, preferably is 0 to 70, and more preferably is 0 to 60. The sum of a, b and c is an integer of 10 to 90, preferably is 15 to 75, and more preferably is 20 to 60.

The compound represented by the formula (Ia) or (Ib) is a polyoxyethylene sorbitan fatty acid ester. Sorbitan is synthesized by dehydrating (removing one molecule of water from) sorbitol, which is synthesized by reducing glucose. The compound of the formula (Ia) or (Ib) is synthesized by an ester reaction of sorbitan with a fatty acid and an addition reaction of sorbitan with ethylene oxide. The formulas (Ia) and (Ib) mean isomers formed at the dehydrating reaction of sorbitol. The ratio of the formula (Ia) to the formula (Ib) usually is 0.1 to 0.9.

The compound of the formula (Ia) or (Ib) is commercially available (e.g., Reodol TW-L120, Kao Co., Ltd.).

Examples of the compounds of the formula (Ia) or (Ib) in the form of the mixtures of the isomers are shown below.

| Number | $R^1$ | a + b + c | Number | $R^1$ | a + b + c |
|---|---|---|---|---|---|
| I-1 | $C_5H_{11}$ | 10 | I-2 | $C_7H_{15}$ | 15 |
| I-3 | $C_9H_{19}$ | 20 | I-4 | $C_{11}H_{23}$ | 20 |
| I-5 | $C_{11}H_{23}$ | 30 | I-6 | $C_{11}H_{23}$ | 40 |
| I-7 | $C_{13}H_{27}$ | 30 | I-8 | $C_{13}H_{27}$ | 40 |
| I-9 | $C_{13}H_{27}$ | 50 | I-10 | $C_{15}H_{31}$ | 40 |
| I-11 | $C_{15}H_{31}$ | 50 | I-12 | $C_{15}H_{31}$ | 60 |
| I-13 | $C_{17}H_{35}$ | 35 | I-14 | $C_{17}H_{35}$ | 45 |
| 1-15 | $C_{17}H_{35}$ | 55 | I-16 | $C_{23}H_{47}$ | 60 |
| I-17 | $C_{23}H_{47}$ | 90 | I-18 | $C_{17}H_{33}$ | 35 |
| I-19 | $C_{17}H_{33}$ | 55 | I-20 | $C_{17}H_{33}$ | 75 |

The second embodiment of the present invention uses a compound represented by the formula (II):

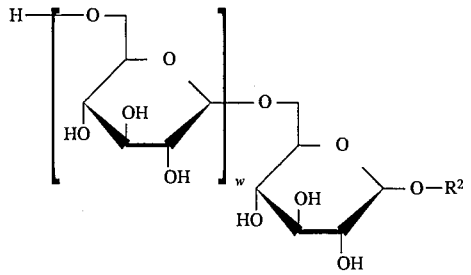

(II)

In the formula (II), $R^2$ is an alkyl group having 4 to 24 carbon atoms, preferably is an alkyl group having 6 to 20 carbon atoms, and more preferably is an alkyl group having 8 to 18 carbon atoms.

The alkyl group preferably has a chain structure, though it may have a cyclic structure. The alkyl group of the chain structure may have a branched chain.

In the formula (II), w is 0 to 3. The compound of the formula (II) is usually in the form of a mixture, wherein the number of w is 0, 1, 2 or 3. In the mixture, the average number of w is preferably in the range of 0.3 to 2.5, and more preferably in the range of 0.4 to 2.0.

The compound of the formula (II) is commercially available (e.g., Glucopon, Henkel Hakusui Co., Ltd.).

Examples of the compounds of the formula (II) in the form of the mixtures are shown below.

| Number | $R^2$ | w | Number | $R^2$ | w |
|---|---|---|---|---|---|
| II-1 | $C_8H_{17}$ | 0.3 | II-2 | $C_8H_{17}$ | 0.5 |
| II-3 | $C_8H_{17}$ | 0.7 | II-4 | $C_8H_{17}$ | 1.2 |
| II-5 | $C_{10}H_{21}$ | 0.5 | II-6 | $C_{10}H_{21}$ | 0.8 |
| II-7 | $C_{10}H_{21}$ | 1.5 | II-8 | $C_{12}H_{25}$ | 0.6 |
| II-9 | $C_{12}H_{25}$ | 0.9 | II-10 | $C_{12}H_{25}$ | 1.5 |
| II-11 | $C_{12}H_{25}$ | 1.8 | II-12 | $C_{14}H_{29}$ | 0.8 |
| II-13 | $C_{14}H_{29}$ | 1.5 | II-14 | $C_{14}H_{29}$ | 2.0 |
| II-15 | $C_{16}H_{33}$ | 1.0 | II-16 | $C_{16}H_{33}$ | 1.5 |
| II-17 | $C_{18}H_{37}$ | 1.2 | II-18 | $C_{18}H_{37}$ | 2.0 |
| II-19 | $C_4H_9$ | 0.4 | II-20 | $C_{24}H_{49}$ | 3.0 |

The third embodiment of the present invention uses a compound represented by the formula (III):

$$HO-(CH_2CH_2O)_x-(CH_2\overset{\overset{\displaystyle CH_3}{|}}{C}HO)_y-(CH_2CH_2O)_z-H \qquad \text{(III)}$$

In the formula (III), each of x and z is an integer of 0 to 300, preferably is 0 to 250, and more preferably is 0 to 200. The sum of x and z (the average number of the addition units of ethylene oxide) is an integer of 20 to 300, preferably is 40 to 250, and more preferably is 50 to 200.

In the formula (III), y (the average number of the addition units of propylene oxide) is an integer of 15 to 70, preferably is 25 to 60, and more preferably is 35 to 50.

The compound of the formula (III) is commercially available (e.g., Pluronic, BASF Japan Co., Ltd.).

Examples of the compounds of the formula (III) are shown below.

| Number | x + z | y | Number | x + z | y |
|---|---|---|---|---|---|
| III-1 | 20 | 15 | III-2 | 85 | 15 |
| III-3 | 25 | 30 | III-4 | 40 | 30 |
| III-5 | 150 | 30 | III-6 | 140 | 25 |
| III-7 | 50 | 35 | III-8 | 250 | 70 |
| III-9 | 45 | 35 | III-10 | 105 | 35 |
| III-11 | 40 | 45 | III-12 | 50 | 40 |
| III-13 | 120 | 40 | III-14 | 210 | 40 |
| III-15 | 15 | 50 | III-16 | 265 | 50 |
| III-17 | 300 | 55 | III-18 | 200 | 65 |
| III-19 | 100 | 35 | III-20 | 230 | 60 |

The fourth embodiment of the present invention uses a compound represented by the formula (IV):

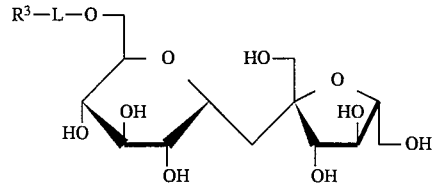

(IV)

In the formula (IV), $R^3$ is an alkyl group having 4 to 24 carbon atoms or an alkenyl group having 4 to 24 carbon atoms, preferably is an alkyl group having 6 to 20 carbon atoms or an alkenyl group having 6 to 20 carbon atoms, and more preferably is an alkyl group having 8 to 18 carbon atoms or an alkenyl group having 8 to 18 carbon atoms.

The alkyl group and the alkenyl group preferably have chain structures, though they may have cyclic structures. The alkyl and alkenyl groups of the chain structures may have branched chains. The alkyl group is preferred to the alkenyl group. There is no specific limitation with respect to the position of the double bond in the alkenyl group.

In the formula (IV), L is a single bond, —CO—, —NH—CO— or —OP(O)(OR$^4$)—. In other words, R$^3$ and sucrose is bound with ether, ester, amido or phosphoric ester. Ester (i.e., —CO—) is particularly preferred.

R$^4$ is hydrogen, an alkyl group having 1 to 24 carbon atoms or an alkenyl group having 2 to 24 carbon atoms. The number of the carbon atoms of the alkyl group preferably is 1 to 20, and more preferably is 4 to 18. The number of the carbon atoms of the alkenyl group preferably is 2 to 20, and more preferably is 4 to 20.

The alkyl group and the alkenyl group preferably have chain structures, though they may have cyclic structures. The alkyl and alkenyl groups of the chain structures may have branched chains. Hydrogen and the alkyl group are preferred to the alkenyl group. There is no specific limitation with respect to the position of the double bond in the alkenyl group.

The compound represented by the formula (IV) can be classified into sucrose ether (IVa), sucrose ester (IVb), sucrose amide (IVc) and sucrose phosphoric ester (IVd) according to the kinds of the linking group (L).

The compound of the formula (IV) can be synthesized by a reaction of sucrose with an alcohol (IVa), a fatty acid (IVb), an isocyanate (IVc) or a phosphoric monoester or diester (IVd).

Examples of the compounds of the formula (IV) are shown below referring to the formulas (IVa), (IVb), (IVc) and (IVd).

(IVa)

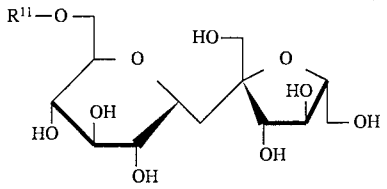

In the formula (IVa), R$^{11}$ has the same meaning as R$^3$ in the formula (IV) .

| Number | R$^{11}$ | Number | R$^{11}$ | Number | R$^{11}$ |
|---|---|---|---|---|---|
| IVa-1 | $C_4H_9$ | IVa-2 | $C_6H_{13}$ | IVa-3 | $C_8H_{17}$ |
| IVa-4 | $C_{10}H_{21}$ | IVa-5 | $C_{12}H_{25}$ | IVa-6 | $C_{14}H_{29}$ |
| IVa-7 | $C_{16}H_{33}$ | IVa-8 | $C_{18}H_{37}$ | IVa-9 | $C_{18}H_{35}$ |
| IVa-10 | $C_{20}H_{41}$ | IVa-11 | $C_{24}H_{49}$ | | |

(IVb)

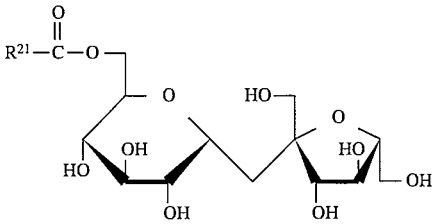

In the formula (IVb), R$^{21}$ has the same meaning as R$^3$ in the formula (IV).

| Number | R$^{21}$ | Number | R$^{21}$ | Number | R$^{21}$ |
|---|---|---|---|---|---|
| IVb-1 | $C_5H_{11}$ | IVb-2 | $C_7H_{15}$ | IVb-3 | $C_9H_{19}$ |
| IVb-4 | $C_{11}H_{23}$ | IVb-5 | $C_{13}H_{27}$ | IVb-6 | $C_{15}H_{31}$ |
| IVb-7 | $C_{17}H_{35}$ | IVb-8 | $C_{17}H_{33}$ | IVb-9 | $C_{19}H_{39}$ |
| IVb-10 | $C_{21}H_{43}$ | IVb-11 | $C_{23}H_{47}$ | | |

(IVc)

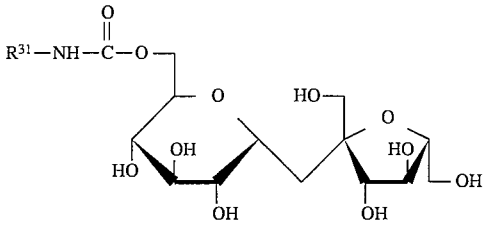

In the formula (IVc), R$^{31}$ has the same meaning as R$^3$ in the formula (IV).

| Number | R$^{31}$ | Number | R$^{31}$ | Number | R$^{31}$ |
|---|---|---|---|---|---|
| IVc-1 | $C_4H_9$ | IVc-2 | $C_6H_{13}$ | IVc-3 | $C_8H_{17}$ |
| IVc-4 | $C_{10}H_{21}$ | IVc-5 | $C_{12}H_{25}$ | IVc-6 | $C_{14}H_{29}$ |
| IVc-7 | $C_{16}H_{33}$ | IVc-8 | $C_{18}H_{37}$ | IVc-9 | $C_{18}H_{35}$ |
| IVc-10 | $C_{20}H_{41}$ | IVc-11 | $C_{24}H_{49}$ | | |

(IVd)

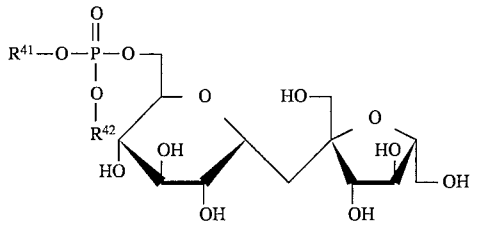

In the formula (IVd), R$^{41}$ and R$^{42}$ have the same meaning as R$^3$ and R$^4$ in the formula (IV) respectively.

| Number | R$^{41}$ | R$^{42}$ | Number | R$^{41}$ | R$^{42}$ |
|---|---|---|---|---|---|
| IVd-1 | $C_4H_9$ | $C_4H_9$ | IVd-2 | $C_6H_{13}$ | $C_6H_{13}$ |
| IVd-3 | $C_8H_{17}$ | $C_8H_{17}$ | IVd-4 | $C_{10}H_{21}$ | $C_{10}H_{21}$ |
| IVd-5 | $C_{12}H_{25}$ | $C_{12}H_{25}$ | IVd-6 | $C_{14}H_{29}$ | $C_{14}H_{29}$ |
| IVd-7 | $C_{16}H_{33}$ | $C_{16}H_{33}$ | IVd-8 | $C_{18}H_{37}$ | $C_{18}H_{37}$ |
| IVd-9 | $C_{20}H_{41}$ | $CH_3$ | IVd-10 | $C_{20}H_{41}$ | $C_4H_9$ |
| IVd-11 | $C_{24}H_{49}$ | H | IVd-12 | $C_{18}H_{37}$ | H |
| IVd-13 | $C_{24}H_{49}$ | H | IVd-14 | $C_{18}H_{37}$ | H |
| IVd-15 | $C_{24}H_{49}$ | H | | | |

Two or more compounds represented by the formula (Ia), (Ib), (II), (III) or (IV) can be used in combination. The compound can also be used with other nonionic surface active agents. In the case that the surface active agent of the present invention is used with other agents, the amount of the agent of the invention preferably is not less than 50 wt. %, and more preferably is not less than 70 wt. % based on the total amount of the surface active agents.

The other nonionic surface active agents include polyoxyethylene fatty acids, polyoxyethylene polyhydric alcohols, polyoxyethylene oils, polyhydric alcohol fatty acid esters and amino acid derivatives.

Examples of the polyoxyethylene fatty acids include polyoxyethylene cetylether stearate, polyoxyethylene stearylether stearate, polyoxyethylene laurylether stearate, polyoxyethylene laurylether isostearate, ethylene glycol dilaurate, polyethylene glycol dilaurate, ethylene glycol monostearate, polyethylene glycol monostearate, polyethylene glycol distearate, polyethylene glycol isostearate, polyethylene glycol diisostearate, polyethylene glycol monooleate and polyethylene glycol dioleate.

Examples of the polyoxyethylene polyhydric alcohols include polyoxyethylene glyceryl isostearate, polyoxyethylene glyceryl triisostearate, polyoxyethylene sorbitan dilaurate, polyoxyethylene sorbitan dioleate, polyoxyethylene sorbitan dipalmitate, polyoxyethylene sorbitan distearate, polyoxyethylene sorbitan tristearate, polyoxyethylene sorbitan trioleate, polyoxyethylene glyceryl trioleate, polyoxyethylene glycerin monostearate, polyoxyethylene glyceryl tristearate, polyoxyethylene glyceryl distearate, polyoxyethylene trimethylolpropane trimyristate, polyoxyethylene trimethylolpropane distearate, polyoxyethylene trimethylolpropane tristearate and polyoxyethylene trimethylolpropane triisostearate.

Examples of the polyoxyethylene oils include polyoxyethylene hardened caster oil, polyoxyethylene caster oil, polyoxyethylene caster oil laurate, polyoxyethylene hardened caster oil isostearate and polyoxyethylene hardened caster oil tristearate.

Examples of the polyhydric alcohol fatty acid esters include sorbitan monostearate, sorbitan monooleate, sorbitan monoisostearate, sorbitan sesquistearate, sorbitan sesquioleate, sorbitan sesquiisostearate, sorbitol tetraoleate, sorbitol tristearate, sorbitan triisostearate, glycerin monostearate, glycerin monopalmitate, diglyceryl monostearate, triglyceryl diisostearate and pentaglyceryl diisostearate.

Examples of the amino acid derivatives include di(polyoxyethylene octyldodecyl ether) N-lauroylglutamate, di(polyoxyethylene stearyl ether) N-lauroylglutamate, polyoxyethylene hardened caster oil pyroglutamate isostearate diester and polyoxyethylene glyceryl monopyroglutamate isostearate diester.

The average number of the oxyethylene units in the nonionic surface active agent is preferably in the range of 5 to 400, and more preferably in the range of 10 to 250.

The amount of the nonionic surface active agent in the coating solution is preferably in the range of 0.01 to 1.0 wt. %, more preferably in the range of 0.01 to 0.5 wt. %, and most preferably in the range of 0.02 to 0.3 wt. %. The formed antistatic backing layer usually contains the nonionic surface active agent in the amount of 0.05 to 10 wt. %.

[Electroconductive Particles]

The electroconductive particles are preferably made of metal oxide. Metals of the metal oxides include Zn, Ti, Sn, Al, In, Si, Mg, Ba, Mo, W and V. Examples of the metal oxides include ZnO, $TiO_2$, $SnO_2$, $Al_2O_3$, $In_2O_3$, $SiO_2$, MgO, BaO, $MoO_3$ and $V_2O_5$. The particles are preferably in the form of crystals of the metal oxides. The particles may comprise two or more metal oxides. The particles preferably comprise $SnO_2$ as the main component and antimony oxide in an amount of 5 to 20 wt. %. The complex particles may further contain other components such as silicon dioxide, boron and phosphorus.

The volume resistance of the electroconductive particles is preferably not higher than $10^7$ Ωcm, and more preferably is not higher $10^5$ Ωcm.

The electroconductive particles have an average particle size preferably in the range of 0.002 to 0.7 μm, and more preferably in the range of 0.005 to 0.3 μm.

The antistatic backing layer contains the electroconductive particles preferably in an amount of 30 to 97 wt. %, more preferably in an amount of 50 to 95 wt. %, and most preferably in an amount of 60 to 90 wt. %.

[Binder]

A hydrophilic polymer is preferred to a hydrophobic polymer as the binder of the antistatic backing layer. The hydrophilic polymer preferably is soluble in water. Examples of the hydrophilic polymers include protein (e.g., gelatin, gelatin derivatives), polysaccharides (e.g., cellulose derivatives, agar, sodium alginate, starch), polyvinyl alcohol, acrylic or methacrylic polymers and maleic anhydride polymers. The cellulose derivatives include carboxymethylcellulose and hydroxyethylcellulose. Examples of the hydrophobic polymers include cellulose esters (e.g., nitrocellulose, diacetylcellulose, methylcellulose), vinyl polymers (e.g., vinyl chloride, vinylidene chloride, vinyl acrylate), polyamides and polyesters.

Gelatin, gelatin derivatives, acrylic polymers and cellulose derivatives are preferably used. Gelatin and gelatin derivatives are particularly preferred.

The antistatic backing layer contains the binder preferably in an amount of 3 to 70 wt. %, more preferably in an amount of 5 to 40 wt. %, and most preferably in an amount of 10 to 40 wt. %.

[Antistatic Backing Layer]

The antistatic backing layer is provided on the backing side (the opposite side to the side of an emulsion layer) of the plastic support. The antistatic backing layer is preferably directly formed on the side of the support.

The antistatic backing layer may further contain additives other than the nonionic surface active agent, the electroconductive particles and the binder. An example of the additive is a hardening agent such as polyglycerol polyglycidyl ether and sorbitol polyglycidyl ether.

The antistatic backing layer is formed by coating a coating solution on a plastic support. The coating solution is prepared by dissolving, dispersing or emulsifying the above-mentioned components in a medium. The medium preferably is an aqueous medium containing water. The other medium components (such as organic solvents) are preferably miscible in water. Examples of the organic solvents miscible in water include a lower alcohol (e.g., methanol, ethanol) and a lower ketones (e.g., acetone, methyl ethyl ketone). In the mixture of water and the organic solvent, the ratio of water is preferably not less than 5 wt. %, and more preferably not less than 10 wt. %, and most preferably not less than 20 wt. %.

The antistatic backing layer is formed preferably after a hydrophilic treatment (e.g., glow discharge treatment, ultraviolet irradiation treatment, corona discharge treatment) of the support. The antistatic layer is formed preferably before a silver halide emulsion layer is formed. Further, the formation of the antistatic layer is preferably conducted before a thermal treatment of the support. The most preferred order of the steps is shown below.

(1) Formation of a plastic support (2) Hydrophilic treatment of the plastic support (3) Formation of an antistatic backing layer (4) Thermal treatment of the plastic support (5) Formation of a protective backing layer (6) Formation of silver halide emulsion layers The antistatic backing layer has a volume resistance preferably in the range of $10^{12}$ to $10^3$ Ω, and more preferably in the range of $10^9$ to $10^3$ Ω.

The antistatic backing layer has a thickness preferably in the range of 20 to 500 nm, more preferably in the range of 30 to 300 nm, and most preferably in the range of 40 to 150 nm.

The thermal treatment after the formation of the antistatic backing layer is preferably conducted at a temperature of 50° C. to the glass transition temperature of the plastic of the support. The heating time is preferably in the range of 0.1 to 1,500 hours, more preferably in the range of 0.5 to 200 hours, and most preferably in the range of 1 to 100 hours.

The heating temperature is preferably so adjusted that the temperature is gradually lowered within the heating time. The thermal treatment may be repeated twice or more.

[Other Backing Layers]

Examples of the other backing layers include an anticurl backing layer, a protective backing layer, an antihalation backing layer and a slipping layer. The antistatic backing layer is preferably directly provided on the support as the first backing layer. Accordingly, the other backing layers are preferably provided on the antistatic backing layer.

A silver halide emulsion layer may be provided on the backing side of the support in addition to an emulsion layer provided on the opposite side of the support. A medial X-ray photographic material has at least two silver halide emulsion layers on both sides of the support. The present invention is also effective in the photographic material having two or more emulsion layers on both sides of the support.

[Plastic Support]

The plastic support is made of a cellulose derivative (e.g., triacetylcellulose) or a polyester (e.g., polyethylene terephthalate, polyethylene naphthalate). The present invention is particularly effective in the polyester support.

The polyester support has a glass transition temperature preferably in the range of 90° to 200° C. The glass transition temperature is measured by using a differential scanning calorimeter (DSC). In more detail, 10 mg of a sample is heated to 300° C. at a heating rate of 20° C. per minute, and then quickly cooled to the room temperature. The sample is heated again at the rate of 20° C. per minute. The temperature deviated from the base line and the temperature returning to a new base line are measured. The glass transition temperature (Tg) means the arithmetic average of the measure two temperatures.

The polyester is usually synthesized from a reaction of a carboxylic acid with a polyol.

A preferred carboxylic acid is an aromatic polycarboxylic acid. Particularly, 2,6-naphthalene dicarboxylic acid (NDCA) is preferred. NDCA is preferably used in an amount of not less than 10 mol %, and more preferably not less than 30 mol % based on the total amount of the carboxylic acid.

Examples of the carboxylic acids are shown below.

| Abbreviation | Name |
|---|---|
| NDCA | 2,6-Dinaphthalenedicarboxylic acid |
| TPA | Terephthalic acid |
| IPA | Isophthalic acid |
| PPDC | Paraphenylenedicarboxylic acid |
| PHBA | Parahydroxybenzoic acid |
| SIP | 3-Sulfoisophthalic acid |

Examples of the polyols are shown below.

| Abbreviation | Name |
|---|---|
| EG | Ethylene glycol |
| CHDM | Cyclohexane dimethanol |
| BPA | Bisphenol A |
| NPG | Neopentyl glycol |
| BP | Biphenol |

A homopolymers is formed from one carboxylic acid (COOH) and one polyol (OH). Examples of the homopolymers are shown below.

| Abbr. | Name | COOH | OH | Tg |
|---|---|---|---|---|
| PEN | Polyethylene-2,6-dinaphthalate | NDCA | EG | 109° C. |
| PCT | Polycyclohexane dimethanol terephthalate | TPA | CHDM | 93° C. |
| PAr | Polyarylate | TPA | BPA | 192° C. |
| PET | Polyethylene terephthalate | TPA | EG | 69° C. |

A copolymer is formed from two or more carboxylic acids (COOH) or two or more polyols (OH). Examples of the copolymers are shown below.

| No. | COOH | OH | Ratio | Tg |
|---|---|---|---|---|
| CP1 | NDCA + TPA | EG | (50 + 50)/100 | 92° C. |
| CP2 | NDCA + TPA | EG | (75 + 25)/100 | 102° C. |
| CP3 | NDCA + TPA | EG + BPA | (50 + 50)/(75 + 25) | 112° C. |
| CP4 | TPA | EG + BPA | 100/(50 + 50) | 105° C. |
| CP5 | TPA | EG + BPA | 100/(25 + 75) | 135° C. |
| CP6 | TPA | EG + CHDM + BPA | 100/(25 + 25 + 50) | 15° C. |
| CP7 | IPA + PPDC + TPA | EG | (20 + 50 + 30)/100 | 95° C. |
| CP8 | NDCA | NPG + EG | 100/(70 + 30) | 105° C. |
| CP9 | TPA | EG + BP | 100/(20 + 80) | 115° C. |
| CP10 | PHBA + TPA | EG | (50 + 50)/100 | 125° C. |

Further, a polymer mixture can be used in the present invention. Examples of the polymer mixtures are shown below.

| No. | Polymers | Ratio | Tg |
|---|---|---|---|
| PM1 | PEN + PET | 80 + 20 | 104° C. |
| PM2 | PEN + PET | 60 + 40 | 95° C. |
| PM3 | PEN + PET | 30 + 70 | 85° C. |
| PM4 | PEN + PET | 25 + 75 | 83° C. |
| PM5 | PAr + PEN | 50 + 50 | 142° C. |
| PM6 | PAr + PCT | 50 + 50 | 118° C. |
| PM7 | PAr + PET | 60 + 40 | 101° C. |
| PM8 | PEN + PET + PAr | 50 + 25 + 25 | 108° C. |
| PM9 | PEN + (SIP/EG) | 99 + (1/1) | 115° C. |

At the synthesis reaction of the polyester, a monomer having an unsaturated group may be copolymerized with the carboxylic acid or the polyol. The unsaturated group can be cross-linked by a radical.

The polyester has an average molecular weight preferably in the range of 5,000 to 200,000.

The plastic support has a thickness usually in the range of 50 to 300 μm, preferably in the range of 50 to 200 μm, more preferably in the range of 80 to 115 μm, and most preferably in the range of 85 to 105 μm.

In the case that the photographic material is prepared in the form of a roll film, the core of the film has a diameter preferably in the range of 5 to 11 mm.

An ultraviolet absorbent can be incorporated into the plastic support to improve the stability of the support. The ultraviolet absorbent preferably does not absorb light within visible regions.

Examples of the ultraviolet absorbents include benzophenones (e.g., 2,4-dihydroxybenzophenone, 2-hydroxy-4-methoxybenzophenone, 2-hydroxy-4-n-octoxybenzophenone, 4-dodecyloxy-2-hydroxybenzophenone, 2,2',4,4'-tetrahydroxybenzophenone, 2,2'-dihydroxy-4,4'-dimethoxybenzophenone), benzotriazoles (e.g., 2-(2'-hydroxy-5-methylphenyl)benzotriazole, 2-(2'-hydroxy-3',5'-di-t-butylphenyl)benzotriazole, 2-(2'-hydroxy-3'-di-t-butyl-5'-methylphenyl)benzotriazole) and salicylic compounds (e.g., phenyl salicylate, methyl salicylate).

The plastic support contains the ultraviolet absorbent preferably in an amount of 0.5 to 20 wt. %, and more preferably in an amount of 1 to 10 wt. %.

Inactive inorganic particles or dyes can be added to the plastic support to prevent a light piping phenomenon. The dyes are preferred to the inorganic particles because the dyes scarcely increase the film haze.

The hue of the dye preferably is gray. The dye preferably has a thermal resistance at the temperature while forming the plastic support. The dye preferably is soluble in the plastic of the support. A dye for a polyester support is commercially available (e.g., Diaresin of Mitsubishi Chemical Co., Ltd., Kayaset of Nippon Kayaku Co., Ltd.).

Two or more dyes can be used in combination.

Inactive inorganic particles can be incorporated into the plastic support as a slipping agent. A surface active agent can also be coated on the support as the slipping agent.

Examples of the inactive inorganic particles include $SiO_2$, $TiO_2$, $BaSO_4$, $CaCO_3$, talc and kaolin. The particles are preferably inactive at the synthesis reactions of the polyester. Further, catalysts in the form of particles for the polymerization reaction of the polyester can be precipitated to function as the slipping agent. The slipping agent can be added to a backing layer (a slipping layer).

The slipping agent contained in the slipping layer preferably is $SiO_2$, which has a refractive index similar to the index of the polyester film. The slipping agent contained in the support preferably has a small particle size.

A layer may be laminated on the support to obtain a high transparency. The lamination can be conducted by two or more extruding machines, a feed block machine or a multi manifold dies.

The plastic support is preferably subjected to a hydrophilic treatment before forming the backing layers and the emulsion layers. Examples of the hydrophilic treatments include a glow discharge treatment, an ultraviolet irradiation treatment and a corona discharge treatment. The glow discharge treatment is particularly preferred.

[Emulsion Layer and Other Layers on the Emulsion Side]

A silver halide emulsion layer is provided on the plastic support. Other functional layers such as an undercoating layer, an intermediate layer, a filter layer and a protective layer may be provided on the emulsion side of the support. The layers on the emulsion side usually are hydrophilic colloidal layers containing a hydrophilic polymer (e.g., gelatin) as the binder.

Examples of the hydrophilic polymers include protein (e.g., gelatin, gelatin derivatives), polysaccharides (e.g., cellulose derivatives, agar, sodium alginate, starch), polyvinyl alcohol, acrylic or methacrylic polymers and maleic anhydride polymers. The cellulose derivatives include carboxymethylcellulose and hydroxyethylcellulose. The acrylic polymers include polyacrylamides and polyacrylic esters. The derivatives of the polymers and partial decomposition products of the polymers can also be used as the hydrophilic polymer. Two or more hydrophilic polymers can be used in combination.

Gelatin and gelatin derivatives are usually used as the hydrophilic polymer.

Gelatin is made from collagen or ossein, which is the main component of animal bone or skin. Gelatin is classified into an acid-treated gelatin, a lime-treated gelatin an enzyme-treated gelatin according to the preparation method. The acid-treated gelatin is prepared by using an acid such as hydrochloric acid. A gelatin derivative is prepared by substituting a functional group of gelatin. Gelatin and gelatin derivatives are described in Arther Veis, The Macromolecular Chemistry of Gelatine, Academic Press (1964), pages 187 to 217.

The undercoating layer can contain a hardening agent for gelatin. Examples of the gelatin hardening agents include polyamide-epichlorohydrin resins (described in Japanese Patent Provisional Publication No. 51(1976)-3619), chromium salts (e.g., chrome alum), aldehydes (e.g., formaldehyde, glutaric aldehyde), isocyanates, cyanuric chloride compounds, vinylsulfonyl compounds, sulfonyl compounds, chlorinated carbamoyl ammonium compounds, amidinium salts, carbodiimides and pyridinium salts.

The layered structure of the emulsion layer is determined according to the use of a color or black and white photographic material.

The silver halide photographic material of the present invention is preferably used as a color print or a color reversal film. The photographic material of the invention is advantageously used as a negative photographic material for a color print.

The photographic material for the color print usually has two or more silver halide emulsion layers, which have the same spectral sensitivity, but are different form each other with respect to the strength of the sensitivity. There is no specific limitation with respect to the number and order of the silver halide emulsion layers and non-light-sensitive layers. The photographic material usually comprises a support, at least one red sensitive layer, at least one green sensitive layer and at least one blue sensitive layer. In a typical case, the photographic material usually comprises a support, red sensitive layers, green sensitive layers and blue sensitive layers in the order. In some cases, a photographic material have the emulsion layers in the reversed order. A silver halide emulsion layer having a spectral sensitivity may be provided between layers having another spectral sensitivity.

Non-light-sensitive layers such as intermediate layers may be provided between the emulsion layers, or provided as the lowermost layer or the uppermost layer.

The silver halide emulsion is usually subjected to a physical ripening, a chemical ripening (sensitization) and a spectral sensitization. The chemical sensitization is preferably conducted using a gold sensitizer and a sulfur sensitizer. The additives for the physical ripening, the chemical sensitization and the spectral sensitization are described in Research Disclosure Nos. 17643 and 18716.

The other additives for photographic materials are also described in Research Disclosure Nos. 17643 and 18716, as follows.

| Additives | No. 17643 | No. 18716 |
|---|---|---|
| Chemical sensitizers | Page 23 | Page 648, right column |
| Sensitivity increasing agent | | Page 648, right column |
| Spectral sensitizing dye and Supersensitizer | Pages 23 to 24 | Page 648, right column to page 649, right column |
| Breaching agent | Page 24 | |
| Antifogging agent and stabilizer | Page 24 to 25 | Page 649, right column |
| Light absorbing agent, filter dye and ultraviolet absorbent | Pages 25 to 26 | Page 650, right column |
| Stain inhibitor | Page 25, right column | Page 650 |
| Color image stabilizer | Page 25 | |
| Hardening agent | Page 26 | Page 651, right column |
| Binder | Page 26 | Page 651, right column |
| Plasticizer and slip agent | Page 27 | Page 650, right column |
| Coating aid and surface active agent | Pages 26 to 27 | Page 650, right column |

The silver halide photographic material can contain various couplers. The couplers are described in Research Disclosure No. 17643, VII-C to G.

Further, a formaldehyde scavenger can be added to the silver halide photographic material to prevent the material from degradation caused by a formaldehyde gas. The scavenger reacts with the gas to fix it. The formaldehyde scavenger is described in U.S. Pat. Nos. 4,411,987 and 4,435,503.

The silver halide photographic material of the invention can be prepared according to a recently proposed new format of a photographic film having a transparent magnetic recording layer.

The transparent magnetic recording layer can be provided on the antistatic layer. The magnetic layer contains strong magnetic particles, which are described in Japanese Patent Provisional Publication Nos. 59(1984)-23505, 4(1992)-195726 and 6(1994)-59357.

The magnetic layer may be in the form of a stripe, which is described in Japanese Patent Provisional Publication Nos. 4(1992)-124642 and 4(1992)-124645.

If necessary, the photographic material can be subjected to an antistatic treatment before a silver halide emulsion is coated, as is described in Japanese Patent Provisional Publication No. 4(1992)-62543. The silver halide emulsions are described in Japanese Patent Provisional Publication Nos. 3(1991)-41436, 3(1991)-41437 and 4(1992)-166932.

The photographic material having the magnetic layer can be prepared according to a process described in Japanese Patent Publication No. 4(1992)-86817. The data of the preparation method can be recorded, as is described in Japanese Patent Publication No. 6(1994)-87146. The photographic can be cut into films having a width narrower than the conventional 135 size before or after recording the data, as is described in Japanese Patent Provisional Publication No. 4(1992)-125560. The film is then subjected to perforation to form two holes per one format image, which is smaller than the conventional format image.

The prepared film is placed in a cartridge type package described in Japanese Patent Publication No. 4(1992)-157459, a cartridge shown in FIG. 9 of Japanese Patent Provisional Publication No. 5(1993)-210202, a film patrone described in U.S. Pat. No. 4,221,479 or a cartridge described in U.S. Pat. Nos. 4,834,306, 4,834,366, 5,226,613 and 4,846,418.

The tongue of the film is preferably stored in the film cartridge or the patrone to shield light, as is described in U.S. Pat. Nos. 4,848,693 and 5,317,355. A locking mechanism can be attached to the cartridge, as is described in U.S. Pat. No. 5,347,334. A display for the using conditions can also be attached to the cartridge, as is described in U.S. Pat. No. 5,347,334. Further, the cartridge preferably has a mechanism of preventing double exposure.

A film is attached to the cartridge preferably by only inserting the film into the cartridge, as is Japanese Patent Provisional Publication No. 6(1994)-85128.

The film cartridge is used in a camera, a developing machine or a lab machine.

The camera preferably has a mechanism using the above-mentioned functions of the film cartridge or patrone. For example, Japanese Patent Provisional Publication Nos. 6(1994)-8886 and 6(1994)-99908 disclose a camera having an easy attachment mechanism for a film. Japanese Patent Provisional Publication Nos. 6(1994)-57398 and 6(1994)-101135 disclose an automatic film winding camera. Japanese Patent Provisional Publication No. 6(1994)-205690 discloses a camera having a mechanism for replacing a film while using the film. Japanese Patent Provisional Publication Nos. 5(1993)-295690 and 5(1993)-283382 disclose a camera having a mechanism for recording information of exposure on a magnetic recording layer. The information includes the aspect ratio of the exposure (e.g., panoramic size, 9×16 size, conventional size). According to the recorded information, the aspect ratio of the print can be determined. Japanese Patent Provisional Publication No. 6(1996)-101194 discloses a camera having a mechanism of preventing double exposure. Japanese Patent Provisional Publication No. 5(1993)-150577 discloses a display for using conditions.

The films can be developed in an automatic developing machine described in Japanese Patent Provisional Publication Nos. 6(1994)-222514 and 6(1994)-222545. The recorded magnetic information can be used before or after the development, as is described in Japanese Patent Provisional Publication Nos. 6(1994)-95265 and 4(1992)-123054. The aspect ratio can be determined before or after the development, as is described in Japanese Patent Provisional Publication No. 5(1993)-19364.

A splice treatment can be used when a motion picture film is processed, as is described in Japanese Patent Provisional Publication No. 5(1993)-119461.

An attach or detach treatment can be conducted with or after the development process, as is described in Japanese Patent Provisional Publication No. 6(1994)-148805.

After the process, the film information can be converted into a print by a back print or a front print for a color paper.

The print can be returned to users with an index print and a cartridge for reuse, as is described in Japanese Patent Provisional Publication Nos. 5(1993) -11353 and 5(1993)-232594.

EXAMPLE 1

(1) Preparation of support (1-1) Formation of plastic support

A dye (Diaresin, Mitsubishi Chemical Co., Ltd.) was added to commercially available polymer pellet of polyethylene 2,6-dinaphthalate (PEN). The amount of the dye was so adjusted that a film of the thickness of 400 nm has the absorption of 0.05 at 400 nm. The mixture was dried according to a conventional method, and was melt at 300° C. The melt was cast from a T-die to form a plastic film. The film was stretched 3.3 times along the longitudinal direction, and was stretched 3.3 times along the lateral direction. The film was thermally fixed at 250° C. for 6 seconds to form a PEN support having the thickness of 90 μm and the width of 30 cm.

(1-2) Surface treatment of plastic film

The plastic film was subjected to the following glow discharge treatment.

Four electrodes of a cylinder bar type was placed on an insulating board at an interval of 10 cm. The electrode has the sectioned diameter of 2 cm and the length of 40 cm. The obtained electrode board was fixed in a vacuum tank. The plastic support runs parallel to the board at the distance of 15 cm. The surface of the support was treated for 2 seconds. Just before the support passes over the electrode, the support was contacted with the three quarters cycle of a heated roller (diameter: 50 cm) having a thermal controller. The surface temperature of the support was measured by a thermocouple between the heating zone and the electrode zone. According to the measured temperature, the heating temperature of the roller was controlled to adjust the surface temperature to 115° C.

The pressure in the vacuum tank was adjusted to 0.2 Torr. The partial pressure of steam was adjusted to 75%. The discharge frequency was 30 KHz, the power was 2,500 W, and the processing strength was 0.5 KV.A.min per $m^2$.

(2) Formation of first backing (antistatic) layer (2-1) Formation of electroconductive particles dispersion In 3,000 weight parts of ethanol, 230 weight parts of tin(II) chloride and 23 weight parts of antimony trichloride were dissolved to obtain a uniform solution.

To the solution, 1N aqueous solution of sodium hydroxide was dropwise added to adjust the solution to pH 3. Thus co-precipitation of colloidal tin(II) oxide and antimony oxide was obtained. The co-precipitation was placed at 50° C. for 24 hours to obtain reddish brown colloidal precipitation. The average particle size was 0.005 μm.

The reddish brown colloidal precipitation was separated by a centrifuge method. Water was added to the precipitation, the mixture was washed with water, and the precipitation was separated by a centrifuge method. The procedures were repeated three times to remove excess salts.

In 1,5000 weight parts of water, 200 weight parts of colloidal precipitation was dispersed again. The dispersion was sprayed in a calcining furnace heated at 500° C. to obtain bluish complex particles of tin(II) oxide and antimony oxide (average diameter: 0.005 μm). The volume resistance of the fine particle was 25 Ωcm.

With 60 weight parts of water, 40 weight parts of fine particles were mixed. The mixture was adjusted to pH 7.0, and was coarsely dispersed in a stirring machine. The mixture was finely dispersed in a sand mill of a lateral type (Dynomill, Willy A. Backfen AG) for 30 minutes. The secondary coagulated particles have an average diameter of 0.05 μm.

(2-2) Preparation and coating of coating solution

The following coating solution was coated on one side of the plastic support. The solution was dried at 115° C. for 30 seconds to form the antistatic layer having the dry thickness of 0.2 μm.

| Coating solution of antistatic backing layer | |
|---|---|
| Dispersion of electroconductive particles ($SnO_2/Sb_2O_3$, particle size: 0.05 μm) | 7 weight parts |
| Surface active agent (set forth in Table 1) | |
| Water | 89 weight parts |
| Gelatin | 1 weight part |
| Sorbitol polyglycidyl ether | 1 weight part |

(2-3) Thermal treatment of support

The support having the antistatic backing layer was heated at 110° C. for 24 hours, and was cooled to 90° C. at the rate of 1° C. per 1 hour. The thermal treatment was conducted where the support was wound around a core (diameter: 30 cm) while arranging the side for the emulsion layers outside. The support was then wound around a core.

(3) Formation of undercoating layer

The following coating solution was coated on the side (emulsion side) opposite to the side of the antistatic layer by using a wire bar. The coating amount was 10 ml per $m^2$. The coated layer was dried at 115° C. for 2 minutes.

| Coating solution of undercoating layer | |
|---|---|
| Gelatin | 10.0 weight parts |
| Water | 24.0 weight parts |
| Methanol | 961.0 weight parts |
| Salicylic acid | 3.0 weight parts |
| Polyamide-epichlorohydrin resin (described in Synthesis Example 1 of Japanese Patent Provisional Publication No. 51(1976)-3619) | 0.5 weight part |
| Polyoxyethylene nonylphenyl ether (polymerization degree: 10) | 1.0 weight part |

(4) Formation of second backing (protective) layer

The following binder solution was prepared. The solution was dispersed in a sand grinder at 2,000 rpm for 2 hours. Glass beads were used as the dispersing medium.

A toluene diisocyanate compound was added to the binder solution to obtain a coating solution. The amount of the compound was 30 wt. % based on the amount of diacetylcellulose (binder). The coating solution was coated on the antistatic backing layer in the coating amount of 0.3 g per $m^2$ based on the amount of diacetylcellulose. The coated layer was dried at 115° C. for 3 minutes.

| Binder solution of protective backing layer | |
|---|---|
| Silicon dioxide (average particle size: 0.3 μm) | 0.01 weight part |
| Aluminum oxide | 0.03 weight part |
| Diacetylcellulose | 1.0 weight part |
| Methyl ethyl ketone | 9.4 weight parts |
| Cyclohexanone | 9.4 weight parts |
| Polyoxyethylene nonylphenyl ether (polymerization degree: 10) | 0.06 weight part |
| Trimethylolpropane 3-toluene diisocyanate adducts | 0.03 weight part |
| Colloidal silica (average particle size of aerogel: 0.02 μm) | 0.02 weight part |
| $C_8F_{17}SO_2N(CH_3)(CH_2CH_2O)_6H$ | 0.01 weight part |
| Vinylidene difluoride/vinylidene tetrafluoride copolymer (molar ratio: 9/1) | 0.01 weight part |
| Latex of methyl methacrylate/divinyl benzene copolymer (molar ratio: 9/1, average particle size: 1.0 μm) | 0.01 weight part |

(5) Formation of third backing (slipping) layer

With 4 weight parts of n-$C_{17}H_{35}COOC_{30}H_{61}$-n, 1 weight part of n-$C_{30}H_{61}O(CH_2CH_2O)_{10}H$ was mixed. To the mixture, the same amount (by weight) of xylene was added. The resulting mixture was heated at 100° C. to make a solution. To the solution, isopropanol was quickly added to prepare a dispersion. The amount of isopropanol was 10 times (by weight) of the amount of the solution. The dispersion was diluted with a mixture of xylene/cyclohexane/isopropanol (weight ratio: 70/25/5). The resulting concentration of the slipping agent was 0.1 wt. %. The dispersion was finely dispersed in a high pressure homogenizer (25° C., 300 kg/cm$^2$). The solution was coated according to a slide coating method. The coating amount was 15 mg per m$^2$. The coated layer was dried at 115° C. for 5 minutes.

(6)–(20) Formation of layers on the emulsion side

The following first to fifteenth layers were simultaneously coated on the undercoating layer (on the side opposite to the backing layers). The compositions of the first to fifteenth layers are the same as those described in Japanese Patent Provisional Publication No. 6(1994)-118561.

| Layered structure of photographic material | | Number of processing |
|---|---|---|
| Fifteenth layer | Second protective layer | (20) |
| Fourteenth layer | First protective layer | (19) |
| Thirteenth layer | High blue sensitive layer | (18) |
| Twelfth layer | Middle blue sensitive layer | (17) |
| Eleventh layer | Low blue sensitive layer | (16) |
| Tenth layer | Yellow filter layer | (15) |
| Ninth layer | High green sensitive layer | (14) |
| Eighth layer | Middle green sensitive layer | (13) |
| Seventh layer | Low green sensitive layer | (12) |
| Sixth layer | Intermediate layer | (11) |
| Fifth layer | High red sensitive layer | (10) |
| Fourth layer | Middle red sensitive layer | (9) |
| Third layer | Low red sensitive layer | (8) |
| Second layer | Intermediate layer | (7) |
| First layer | Antihalation layer | (6) |
| Undercoating layer | | (3) |
| Plastic support | | (1) |
| First backing layer | Antistatic layer | (2) |
| Second backing layer | Protective backing layer | (4) |
| Third backing layer | Slipping layer | (5) |

(21) Development of photographic material

The photographic material was imagewise exposed to light, and was subjected to a running development in an automatic developing machine (Minilabo FP-560B, Fuji Photo Film Co., Ltd.). The developing conditions are shown below. At the color development (21-1), the amount of the replenisher supplied to a tank was three times the volume of the tank.

| Number | Process | Temperature | Time |
|---|---|---|---|
| (21-1) | Color development | 38° C. | 3 minutes |
| (21-2) | Development stopping | 38° C. | 1 minute |
| (21-3) | Washing with water | 38° C. | 1 minute |
| (21-4) | Bleaching | 38° C. | 2 minutes |
| (21-5) | Washing with water | 38° C. | 1 minute |
| (21-6) | Fixing | 38° C. | 2 minutes |
| (21-7) | Washing with water | 38° C. | 1 minute |
| (21-8) | Stabilizing | 38° C. | 1 minute |

The compositions of the processing solutions are shown below.

| Color developing solution | |
|---|---|
| Sodium hydroxide | 2 g |
| Sodium sulfite | 2 g |

-continued

| Color developing solution | |
|---|---|
| Potassium bromide | 0.4 g |
| Sodium chloride | 1 g |
| Boric acid | 4 g |
| Hydroxylamine sulfate | 2 g |
| Dihydric salt of disodium ethylenediamine tetraacetate | 2 g |
| 4-Amino-3-methyl-N-ethyl-N-(b-hydroxyethyl)aniline monosulfate | 4 g |
| Water (make up to) | 1 liter |

| Development stopping solution | |
|---|---|
| Sodium thiosulfate | 10 g |
| 70 Wt. % aqueous solution of ammonium thiosulfate | 30 ml |
| Acetic acid | 30 ml |
| Sodium acetate | 5 g |
| Potassium alum | 15 g |
| Water (make up to) | 1 liter |

| Bleaching solution | |
|---|---|
| Dihydric salt of iron(III) sodium ethylenediamine tetraacetate | 100 g |
| Potassium bromide | 50 g |
| Ammonium nitrate | 50 g |
| Boric acid | 5 g |
| pH (adjusted with ammonium water) | 5.0 |
| Water (make up to) | 1 liter |

| Fixing solution | |
|---|---|
| Sodium thiosulfate | 150 g |
| Sodium sulfite | 15 g |
| Boric acid | 12 g |
| Glacial acetic acid | 15 ml |
| Potassium alum | 20 g |
| Water (make up to) | 1 liter |

| Stabilizing solution | |
|---|---|
| Boric acid | 5 g |
| Sodium citrate | 5 g |
| Sodium metaphosphate (tetrahydric salt) | 3 g |
| Potassium alum | 15 g |
| Water (make up to) | 1 liter |

(22) Evaluation of photographic material (22-1) Surface of the antistatic layer

After the antistatic layer was coated (2), the surface of the antistatic backing layer was evaluated as the ratio (%) of the area where the coating solution was repelled by the support or where the solution was not uniformly coated on the support.

(22-2) Adhesion under dry conditions

After the emulsion layers were coated (6)–(20), the backing surface was cut with a razor to form 6 groove along each longitudinal and latitudinal directions. Thus, 25 square marks were formed on the backing surface. An adhesive tape (Nitto Tape, Nitto Electric Industrial Co., Ltd.) was pasted on the surface, and peeled from the surface quickly at the direction of 180°. The area where the backing layers were peeled with the tape was measured. The backing layers must have such a strength of adhesion for practical use that the peeled area is not less than 10%.

(22-3) Adhesion under wet conditions

At the color development (21-1), fixing (21-6) and stabilizing (21-8) processes, the backing surface of the photographic material was scratched with a steel pen to mark X on the surface. The mark was strongly rubbed with fingers (protected with rubber) five times. The maximum width of the peeled area along the X mark was measured. When the backing layer was not peeled at the mark, the peeled width is 0 mm. The backing layers must have such a strength of adhesion for practical use that the peeled width is 0 mm.

(22-4) Static mark test

After the emulsion layers were coated (6)–(20), the unexposed photographic material was conditioned at the temperature of 25° C. and the relative humidity of 10% for 6 hours. In a dark room under the same conditions, the photographic material was rubbed with a rubber roller and a urethane roller. The photographic material was then subjected to the development process (21). The number of the static marks was counted per 1 $m^2$ of the photographic material. In a photographic material for practical use, no static mark should be observed.

(22-5) Dust attraction

After the emulsion layers were coated (6)–(20), the photographic material was cut into pieces (20 cm×20 cm). The pieces were rubbed with a nylon fabric at the temperature of 25° C. and the relative humidity of 10%. Cigarette ash was placed near the pieces. The sample pieces were evaluated whether the ash was attracted (grade B) or not (grade A).

A photographic material for practical use must be classified into the grade A.

(23) Results

The results are set forth in Table 1. In Table 1, the amount of the surfactant (surface active agent) means the concentration (wt. %) in the coating solution of the antistatic backing layer.

As is evident from the results shown in Table 1, the surface conditions, the adhesion and the antistatic function of the antistatic backing layer are improved by use of a specific nonionic surface active agent according to the present invention.

TABLE 1

| Sample No. | Surfactant No. | Surfactant Amount | Evaluation of samples (22-1) | (22-2) | (22-3) | (22-4) | (22-5) |
|---|---|---|---|---|---|---|---|
| 1-0 | None | — | 23% | 10% | 12 mm | 25 | B |
| 1-1 | I-3 | 0.50% | 0% | 0% | 0 mm | 0 | A |
| 1-2 | I-5 | 0.50% | 0% | 0% | 0 mm | 0 | A |
| 1-3 | I-8 | 0.50% | 0% | 0% | 0 mm | 0 | A |
| 1-4 | I-10 | 0.50% | 0% | 0% | 0 mm | 0 | A |
| 1-5 | I-15 | 0.50% | 0% | 0% | 0 mm | 0 | A |
| 1-6 | I-16 | 0.50% | 0% | 0% | 0 mm | 0 | A |
| 1-7 | II-6 | 0.50% | 0% | 0% | 0 mm | 0 | A |
| 1-8 | II-7 | 0.50% | 0% | 0% | 0 mm | 0 | A |
| 1-9 | II-10 | 0.50% | 0% | 0% | 0 mm | 0 | A |
| 1-10 | II-15 | 0.50% | 0% | 0% | 0 mm | 0 | A |
| 1-11 | III-5 | 0.50% | 0% | 0% | 0 mm | 0 | A |
| 1-12 | III-6 | 0.50% | 0% | 0% | 0 mm | 0 | A |
| 1-13 | III-14 | 0.50% | 0% | 0% | 0 mm | 0 | A |
| 1-14 | III-20 | 0.50% | 0% | 0% | 0 mm | 0 | A |
| 1-15 | IVa-7 | 0.50% | 0% | 0% | 0 mm | 0 | A |
| 1-16 | IVa-8 | 0.50% | 0% | 0% | 0 mm | 0 | A |
| 1-17 | IVb-7 | 0.50% | 0% | 0% | 0 mm | 0 | A |
| 1-18 | IVb-9 | 0.50% | 0% | 0% | 0 mm | 0 | A |
| 1-19 | IVc-7 | 0.50% | 0% | 0% | 0 mm | 0 | A |
| 1-20 | IVc-8 | 0.50% | 0% | 0% | 0 mm | 0 | A |
| 1-21 | IVd-5 | 0.50% | 0% | 0% | 0 mm | 0 | A |

TABLE 1-continued

| Sample No. | Surfactant No. | Surfactant Amount | Evaluation of samples (22-1) | (22-2) | (22-3) | (22-4) | (22-5) |
|---|---|---|---|---|---|---|---|
| 1-22 | IVd-12 | 0.50% | 0% | 0% | 0 mm | 0 | A |
| 1-23 | X-1 | 0.50% | 3% | 15% | 3 mm | 12 | B |
| 1-24 | X-2 | 0.50% | 5% | 13% | 2 mm | 10 | B |
| 1-25 | X-3 | 0.50% | 3% | 17% | 4 mm | 14 | B |
| 1-26 | I-3 | 0.67% | 0% | 0% | 0 mm | 0 | A |
| 1-27 | I-5 | 0.08% | 0% | 0% | 0 mm | 0 | A |
| 1-28 | I-10 | 0.33% | 0% | 0% | 0 mm | 0 | A |
| 1-29 | I-16 | 0.17% | 0% | 0% | 0 mm | 0 | A |
| 1-30 | II-6 | 0.06% | 0% | 0% | 0 mm | 0 | A |
| 1-31 | II-7 | 0.38% | 0% | 0% | 0 mm | 0 | A |
| 1-32 | II-10 | 0.28% | 0% | 0% | 0 mm | 0 | A |
| 1-33 | II-15 | 0.97% | 0% | 0% | 0 mm | 0 | A |
| 1-34 | III-5 | 0.25% | 0% | 0% | 0 mm | 0 | A |
| 1-35 | III-6 | 0.63% | 0% | 0% | 0 mm | 0 | A |
| 1-36 | III-14 | 0.10% | 0% | 0% | 0 mm | 0 | A |
| 1-37 | III-14 | 0.89% | 0% | 0% | 0 mm | 0 | A |
| 1-38 | III-20 | 0.77% | 0% | 0% | 0 mm | 0 | A |
| 1-39 | IVa-1 | 0.75% | 2% | 0% | 0 mm | 0 | A |
| 1-40 | IVa-10 | 0.80% | 0% | 0% | 0 mm | 0 | A |
| 1-41 | IVb-1 | 0.25% | 1% | 0% | 0 mm | 0 | A |
| 1-42 | IVb-3 | 0.30% | 0% | 0% | 0 mm | 0 | A |
| 1-43 | IVb-6 | 0.01% | 0% | 0% | 0 mm | 0 | A |
| 1-44 | IVb-10 | 0.90% | 0% | 0% | 0 mm | 0 | A |
| 1-45 | IVc-1 | 1.00% | 0% | 0% | 0 mm | 0 | A |
| 1-46 | IVc-2 | 0.30% | 0% | 0% | 0 mm | 0 | A |
| 1-47 | IVc-4 | 0.60% | 0% | 0% | 0 mm | 0 | A |
| 1-48 | IVd-1 | 0.10% | 0% | 0% | 0 mm | 0 | A |
| 1-49 | IVd-6 | 0.90% | 0% | 0% | 0 mm | 0 | A |
| 1-50 | IVd-14 | 0.40% | 0% | 0% | 0 mm | 0 | A |

Comparative nonionic surface active agents (X-1) to (X-3) are shown below.

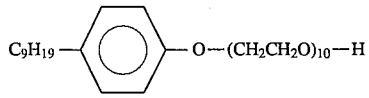

(X-1)

(corresponding to polyoxyethylene nonylphenylether disclosed in U.S. Pat. No. 5,326,689 at column 22, lines 62 to 63)

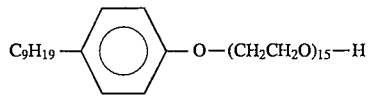

(X-2)

$C_{18}H_{37}-O-(CH_2CH_2O)_{20}-H$ (X-3)

EXAMPLE 2

Silver halide photographic materials were prepared in the same manner as in Example 1, except that the following coating solution of the antistatic backing layer was used.

| Coating solution of antistatic backing layer | |
|---|---|
| Dispersion of electroconductive particles ($SnO_2/Sb_2O_3$, particle size: 0.05 μm) | 10 weight parts |
| Surface active agent (set forth in Table 2) | |
| Water | 27 weight parts |
| Methanol | 60 weight parts |
| Gelatin | 1 weight part |

The samples were evaluated in the same manner as in Example 1. The results are set forth in Table 2. In Table 2, the amount of the surfactant (surface active agent) means the concentration (wt. %) in the coating solution of the antistatic backing layer.

As is evident from the results shown in Table 2, the present invention is also effective where a mixture of water and an organic solvent (methanol) is used in the coating solution.

TABLE 2

| Sample No. | Surfactant No. | Surfactant A-mount | Evaluation of samples (22-1) | (22-2) | (22-3) | (22-4) | (22-5) |
|---|---|---|---|---|---|---|---|
| 2-0 | None | — | 27% | 12% | 12 mm | 28 | B |
| 2-1 | IVa-7 | 0.50% | 2% | 0% | 0 mm | 0 | A |
| 2-2 | IVa-8 | 0.50% | 2% | 0% | 0 mm | 0 | A |
| 2-3 | IVb-7 | 0.50% | 2% | 0% | 0 mm | 0 | A |
| 2-4 | IVb-9 | 0.50% | 2% | 0% | 0 mm | 0 | A |
| 2-5 | IVc-7 | 0.50% | 2% | 0% | 0 mm | 0 | A |
| 2-6 | IVc-8 | 0.50% | 2% | 0% | 0 mm | 0 | A |
| 2-7 | IVd-5 | 0.50% | 3% | 0% | 0 mm | 0 | A |
| 2-8 | IVd-12 | 0.50% | 2% | 0% | 0 mm | 0 | A |
| 2-9 | X-1 | 0.50% | 5% | 17% | 4 mm | 13 | B |
| 2-10 | X-2 | 0.50% | 7% | 15% | 4 mm | 12 | B |
| 2-11 | X-3 | 0.50% | 5% | 20% | 5 mm | 14 | B |
| 2-12 | I-8 | 0.22% | 4% | 0% | 0 mm | 0 | A |
| 2-13 | IVa-2 | 0.05% | 2% | 0% | 0 mm | 0 | A |
| 2-14 | IVa-4 | 0.30% | 3% | 0% | 0 mm | 0 | A |
| 2-15 | IVa-10 | 0.75% | 2% | 0% | 0 mm | 0 | A |
| 2-16 | IVb-3 | 0.01% | 3% | 0% | 0 mm | 0 | A |
| 2-17 | IVb-3 | 0.30% | 2% | 0% | 0 mm | 0 | A |
| 2-18 | IVb-5 | 1.00% | 3% | 0% | 0 mm | 0 | A |
| 2-19 | IVb-6 | 0.20% | 3% | 0% | 0 mm | 0 | A |
| 2-20 | IVb-10 | 0.90% | 3% | 0% | 0 mm | 0 | A |
| 2-21 | IVc-1 | 0.10% | 2% | 0% | 0 mm | 0 | A |
| 2-22 | IVc-10 | 0.60% | 2% | 0% | 0 mm | 0 | A |
| 2-23 | IVd-1 | 0.40% | 2% | 0% | 0 mm | 0 | A |
| 2-24 | IVd-4 | 0.85% | 3% | 0% | 0 mm | 0 | A |

(Remark)

Comparative nonionic surface active agents (X-1) to (X-3) are shown in Table 1.

EXAMPLE 3

Silver halide photographic materials were prepared in the same manner as in the preparation of the sample No. 1-43 in Example 1, except that the plastic support and the thermal treatment conditions were changed according to Table 3.

TABLE 3

| Sample No. | Plastic support Kind | Tg | Thick. | Surface | Thermal treat. Heat | Cool |
|---|---|---|---|---|---|---|
| 1-43 | PEN | 119° C. | 90 μm | Glow | 110° C. | 90° C. |
| 3-1 | PEN | 119° C. | 90 μm | UV | 110° C. | 90° C. |
| 3-2 | PEN | 119° C. | 90 μm | Corona | 110° C. | 90° C. |
| 3-3 | PEN | 119° C. | 60 μm | Glow | 110° C. | 90° C. |
| 3-4 | PEN | 119° C. | 70 μm | Glow | 110° C. | 90° C. |
| 3-5 | PEN | 119° C. | 90 μm | Glow | Not treated | |
| 3-6 | PM1 | 104° C. | 90 μm | Glow | 90° C. | 70° C. |
| 3-7 | PM2 | 95° C. | 90 μm | Glow | 80° C. | 60° C. |
| 3-8 | PM4 | 83° C. | 90 μm | Glow | 70° C. | 50° C. |
| 3-9 | PET | 69° C. | 100 μm | Glow | Not treated | |
| 3-10 | PET | 69° C. | 100 μm | Glow | 60° C. | 50° C. |
| 3-11 | PAr | 192° C. | 90 μm | Glow | 180° C. | 160° C. |
| 3-12 | PCT | 93° C. | 90 μm | Glow | 85° C. | 65° C. |

The glow discharge treatment (Glow) was conducted n the same manner as in Example 1.

The ultraviolet irradiation treatment (UV) was conducted by using a high pressure mercury lump having the main wavelength of 365 nm. The amount of the exposure was 1,000 mJ/cm$^2$.

The corona discharge treatment (Corona) was conducted by using a solid state corona processing machine (Model 6KVA, Pillar). The discharge frequency was 20 KHz, processing strength was 0.05 KV.A.min/m$^2$, and the gap clearance between the electrode and the dielectric roll was 1.5 mm.

The thermal treatment (Thermal treat.) was conducted by heating the support at the heating temperature (Heat) set forth in Table 3 for 24 hours, and then cooling the support to the cooled temperature (Cool) set forth in Table 3 at the cooling rate of 1° C. per one hour.

The samples were evaluated in the same manner as in Example 1. The results are set forth in Table 4. As is evident from the results shown in Table 4, the present invention is effective in various plastic supports.

TABLE 4

| Sample No. | Evaluation of samples (22-1) | (22-2) | (22-3) | (22-4) | (22-5) |
|---|---|---|---|---|---|
| 1-43 | 0% | 0% | 0 mm | 0 | A |
| 3-1 | 0% | 0% | 0 mm | 0 | A |
| 3-2 | 0% | 0% | 0 mm | 0 | A |
| 3-3 | 0% | 0% | 0 mm | 0 | A |
| 3-4 | 0% | 0% | 0 mm | 0 | A |
| 3-5 | 0% | 0% | 0 mm | 0 | A |
| 3-6 | 0% | 0% | 0 mm | 0 | A |
| 3-7 | 0% | 0% | 0 mm | 0 | A |
| 3-8 | 0% | 0% | 0 mm | 0 | A |
| 3-9 | 0% | 0% | 0 mm | 0 | A |
| 3-10 | 0% | 0% | 0 mm | 0 | A |
| 3-11 | 0% | 0% | 0 mm | 0 | A |
| 3-12 | 0% | 0% | 0 mm | 0 | A |

I claim:

1. A process for the preparation of a silver halide photographic material comprising a plastic support, a silver halide emulsion layer and an antistatic backing layer, which comprises steps of: coating a silver halide emulsion on one side of the support to form the silver halide emulsion layer; and coating an aqueous coating solution on the other side of the support to form the antistatic backing layer, wherein the coating solution contains electroconductive particles, a binder and a compound represented by the formula (Ia) or (Ib):

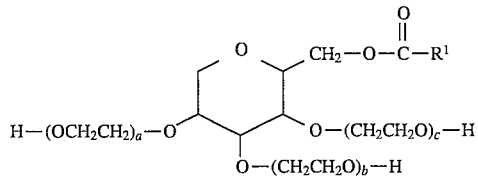

(Ia)

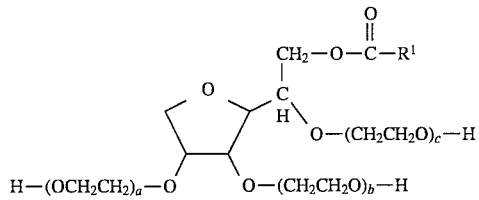

(Ib)

wherein $R^1$ is an alkyl group having 4 to 24 carbon atoms or an alkenyl group having 4 to 24 carbon atoms; each of a, b and c is an integer of 0 to 90, and the sum of a, b and c is an integer of 10 to 90.

2. The process for the preparation of the silver halide photographic material as claimed in claim 1, wherein the coating solution contains the compound in an amount of 0.01 to 1.0 wt. %.

3. The process for the preparation of the silver halide photographic material as claimed in claim 1, wherein the coating solution is directly coated on the side of the support.

4. The process for the preparation of the silver halide photographic material as claimed in claim 1, wherein the plastic support is made of a polyester having a glass transition temperature in the range of 90° to 200° C.

5. The process for the preparation of the silver halide photographic material as claimed in claim 1, wherein the plastic support is subjected to a glow discharge treatment, an ultraviolet irradiation treatment or a corona discharge treatment before the steps of coating the silver halide emulsion and coating the aqueous coating solution.

6. A process for the preparation of a silver halide photographic material comprising a plastic support, a silver halide emulsion layer and an antistatic backing layer, which comprises steps of: coating a silver halide emulsion on one side of the support to form the silver halide emulsion layer; and coating an aqueous coating solution on the other side of the support to form the antistatic backing layer, wherein the coating solution contains electroconductive particles, a binder and a compound represented by the formula (II):

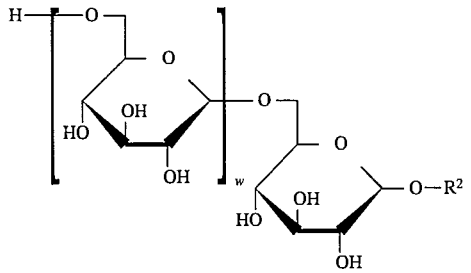

(II)

wherein $R^2$ is an alkyl group having 4 to 24 carbon atoms; and w is 0 to 3.

7. The process for the preparation of the silver halide photographic material as claimed in claim 6, wherein the coating solution contains the compound in an amount of 0.01 to 1.0 wt. %.

8. The process for the preparation of the silver halide photographic material as claimed in claim 6, wherein the coating solution is directly coated on the side of the support.

9. The process for the preparation of the silver halide photographic material as claimed in claim 6, wherein the plastic support is made of a polyester having a glass transition temperature in the range of 90° to 200° C.

10. The process for the preparation of the silver halide photographic material as claimed in claim 6, wherein the plastic support is subjected to a glow discharge treatment, an ultraviolet irradiation treatment or a corona discharge treatment before the steps of coating the silver halide emulsion and coating the aqueous coating solution.

11. A process for the preparation of a silver halide photographic material comprising a plastic support, a silver halide emulsion layer and an antistatic backing layer, which comprises steps of: coating a silver halide emulsion on one side of the support to form the silver halide emulsion layer; and coating an aqueous coating solution on the other side of the support to form the antistatic backing layer, wherein the coating solution contains electroconductive particles, a binder and a compound represented by the formula (III):

$$HO-(CH_2CH_2O)_x-(CH_2\overset{\overset{CH_3}{|}}{C}HO)_y-(CH_2CH_2O)_z-H \quad \text{(III)}$$

wherein each of x and z is an integer of 0 to 300, and the sum of x and z is an integer of 20 to 300; y is an integer of 15 to 70.

12. The process for the preparation of the silver halide photographic material as claimed in claim 11, wherein the coating solution contains the compound in an amount of 0.01 to 1.0 wt. %.

13. The process for the preparation of the silver halide photographic material as claimed in claim 11, wherein the coating solution is directly coated on the side of the support.

14. The process for the preparation of the silver halide photographic material as claimed in claim 11, wherein the plastic support is made of a polyester having a glass transition temperature in the range of 90° to 200° C.

15. The process for the preparation of the silver halide photographic material as claimed in claim 11, wherein the plastic support is subjected to a glow discharge treatment, an ultraviolet irradiation treatment or a corona discharge treatment before the steps of coating the silver halide emulsion and coating the aqueous coating solution.

16. A process for the preparation of a silver halide photographic material comprising a plastic support, a silver halide emulsion layer and an antistatic backing layer, which comprises steps of: coating a silver halide emulsion on one side of the support to form the silver halide emulsion layer; and coating an aqueous coating solution on the other side of the support to form the antistatic backing layer, wherein the coating solution contains electroconductive particles, a binder and a compound represented by the formula (IV):

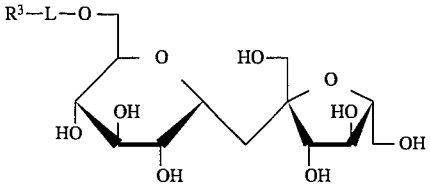

(IV)

wherein $R^3$ is an alkyl group having 4 to 24 carbon atoms or an alkenyl group having 4 to 24 carbon atoms; L is a single bond, —CO—, —NH—CO— or —OP(O)($OR^4$)—, and $R^4$ is hydrogen, an alkyl group having 1 to 24 carbon atoms or an alkenyl group having 2 to 24 carbon atoms.

17. The process for the preparation of the silver halide photographic material as claimed in claim 16, wherein the coating solution contains the compound in an amount of 0.01 to 1.0 wt. %.

18. The process for the preparation of the silver halide photographic material as claimed in claim 16, wherein the coating solution is directly coated on the side of the support.

19. The process for the preparation of the silver halide photographic material as claimed in claim 16, wherein the plastic support is made of a polyester having a glass transition temperature in the range of 90° to 200° C.

20. The process for the preparation of the silver halide photographic material as claimed in claim 16, wherein the plastic support is subjected to a glow discharge treatment, an ultraviolet irradiation treatment or a corona discharge treatment before the steps of coating the silver halide emulsion and coating the aqueous coating solution.

* * * * *